US007366308B1

(12) United States Patent
Kock

(10) Patent No.: US 7,366,308 B1
(45) Date of Patent: Apr. 29, 2008

(54) SOUND PICKUP DEVICE, SPECIALLY FOR A VOICE STATION

(75) Inventor: Gerhard Kock, Wedemark (DE)

(73) Assignee: Beyerdynamic GmbH & Co. KG, Heilbronn (DE)

( * ) Notice: Subject to any disclaimer, the term of this patent is extended or adjusted under 35 U.S.C. 154(b) by 0 days.

(21) Appl. No.: 09/402,726

(22) PCT Filed: Mar. 27, 1998

(86) PCT No.: PCT/DE98/00912

§ 371 (c)(1),
(2), (4) Date: Oct. 8, 1999

(87) PCT Pub. No.: WO98/46043

PCT Pub. Date: Oct. 15, 1998

(30) Foreign Application Priority Data

Apr. 10, 1997 (DE) ..... 197 14 748

(51) Int. Cl.
*H04R 3/00* (2006.01)
*H04R 1/02* (2006.01)

(52) U.S. Cl. ..... 381/92; 381/91; 381/122

(58) Field of Classification Search ..... 381/92, 381/82, 91, 122
See application file for complete search history.

(56) References Cited

U.S. PATENT DOCUMENTS 4,485,484 A 11/1984 Flanagan
4,536,887 A * 8/1985 Kaneda et al. ..... 381/92
5,526,433 A * 6/1996 Zakarauskas et al. ..... 381/92
5,561,737 A * 10/1996 Bowen ..... 704/275
5,600,727 A * 2/1997 Sibbald et al. ..... 381/26
5,862,240 A * 1/1999 Ohkubo et al. ..... 381/356
5,901,232 A * 5/1999 Gibbs ..... 381/92

FOREIGN PATENT DOCUMENTS

| | | |
|---|---|---|
| BE | 664 110 | 11/1965 |
| DE | 39 23 740 | 12/1990 |
| EP | 0 692 923 | 1/1996 |
| FR | 2 517 157 | 5/1983 |
| JP | 61 099880 | 5/1986 |
| WO | WO94/26075 | 11/1994 |

* cited by examiner

*Primary Examiner*—Xu Mei
(74) *Attorney, Agent, or Firm*—Collard & Roe, P.C.

(57) ABSTRACT

The invention relates to a sound recording device for a public address system. Sound is emitted from a sound source, picked up by at least two sound sensors and converted into electrical signals. The sound sensors are located at a distance from a reference position which corresponds to an ideal set position. Directional vectors located between said reference position and the sound sensors indicate different directions. The sound sensors are electrically or acoustically connected to a common signal amplitude add device.

35 Claims, 6 Drawing Sheets

SOUND PICKUP DEVICE, SPECIALLY FOR A VOICE STATION

Figure 1:
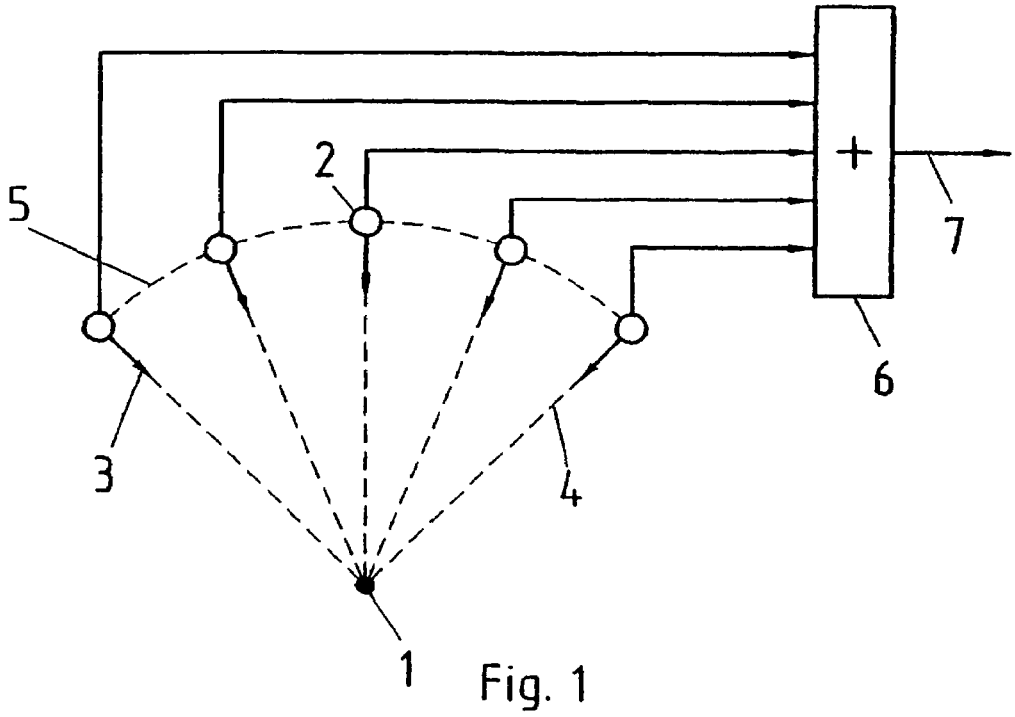

The invention relates to a second recording device, in particular for a public address system in which a sound is emitted from a sound source and recorded by at least two sound recorders and transferred to electric signals.

Sound recording devices in the form of individual microphones are known, which are available with or without directional characteristics. If sound recording devices are used in combination with public address systems at conference centers or speaker podiums, then it is desirable to have a high degree of feedback protection, good isolation from ambient noise, and a high degree of independence of the signal level from different speech directions and speaking positions.

Microphones without directional characteristics will tolerate differing speech directions and speaking positions, however they only offer minimal feedback protection and poor isolation from ambient noise. To compensate for these disadvantages, a smaller amplification scale has to be selected and at the same time much closer voice proximity maintained, so that the sound level of speech into the microphone is great enough to mask ambient noise. Changes in speech directions and speaking positions will cause comparatively larger variations in distance and also sound level fluctuations, compared to maintaining greater speech distance. Furthermore, unpleasant popping noises arise with plosives, created by air movement. In contrast, microphones with directional characteristics offer greater feedback protection and better isolation from ambient noise outside the sound recording range. The limited sound recording range, however results in sound level fluctuations due to deviations in speech direction and/or speaking position. Consequently, sound level fluctuations due to deviations in speech direction and position are present with both types of microphone.

From EP-A-0 692 923 a selective sound recording system for a hall-type and sound filled environment are known. The system comprises multiple electric-acoustic transducers for selecting in phase usable signals from a utility zone of unequal phased signals from other areas. The transducers are mounted on a symmetrically arranged frame with a concave cylindrical surface, oriented to the working zone and divided into groups. The signals of individual transducers are, after matching recording levels, initially fed group-wise to integration devices, then passed through a frequency selective filter, after which the filtered signals of different groups are summated. In this way high frequency signals are extracted from the transducers arranged close to the center of the frame, whilst medium and low frequency signals are extracted from transducers arranged further from the center of the frame.

Further, a device for acoustically locating a speaker is described in WO 94 26075. Here numerous microphones are arranged within a predetermined distance from one another and their signal transmission times are evaluated and compared. The device can be pointed towards the speaker by way of a motor.

The invention is based on the exercise of improving a sound recording device, in particular for public address systems, so that not only a high degree of feedback protection and good isolation from ambient noise is achieved, but also a high degree of independence of the signal level from different speech directions and speaking positions, as well as protection from popping noises.

This exercise is resolved with a sound recording device, in particular for public address systems, according to the invention. Further developments and advantageous configurations of the invention are set forth in the following description.

In the case of the sound recording device according to the invention, the transmitted sound from a sound source from at least two sound recorders is simultaneously recorded. By combining the received signals from all the sound recorders it is possible to record the sound, with even regular levels despite deviations in the propagation path or position of the sound source, as would be possible with just one single sound recorder.

At the same time, the summated amplitudes of the individual output signals of the sound recorder lead in total to an increase in level of sound signals, whose origin is the reference point, and this also leads to a reduction in level of ambient signals (on the transducer frame). Propagated from the reference point, the usable signals of the sound recorders are thereby matched, however noise signals and their noise impedance are unmatched. In this way the signal attenuation of the summated signals is improved by 3 dB with each doubling of the number of sound recorders. By appropriately selecting the number and configuration of sound recorders the position and size of the zone for effective sound recording—as well as noise impedance distance—can be selected. This results in correct operation of the whole sound recording device even when the individual sound recorders themselves do not display any directional characteristics.

The correct operation of the whole sound recording device distinguishes itself advantageously from the directivity of regular directional microphones, since the directivity does not diverge from the sound recorder to the sound source, but converges at the reference point, similar to the focus of a concave mirror. In this way the desired feedback protection and isolation from ambient noise are both achieved, and compared to the potential directivity of individual sound recorders, is again improved. Furthermore greater distance between sound source and sound recorders is made possible, preventing popping sounds which can arise with plosives due to air movement. Besides this, the option exists to accommodate the sound recorder device in a compact casing at a greater distance from the speaker, so that forward view is not obstructed.

Also, deviations in the position of the sound sources are equalized within a restricted area about the reference point. In this way the previously feared volume fluctuation problems caused by movement of the speaker are effectively minimized.

In the simplest case the sound recorders are a consistent distance from the reference position and are arranged on a circular or spherical element, whose centrepoint is formed by the reference position.

This produces determinably consistent transmission times between the reference position and the sound recorders. In this way the signals of the sound recorders can be summated directly.

Transmission time elements can be determined by varying the distances between the reference position and the sound recorders.

Varying distances can be necessary due to design or structural constraints. However in order to maintain consistent transmission times, the various acoustic transmission times can be equalized by the transmission time elements so that the shorter transmission times from the sound recorders, which are arranged closer to the reference position, can be artificially extended.

When using transmission time elements, individual or multiple sound recorders can be integrated together into sound transfer elements, whose transmission dimensions are adjustable to consistent signal levels of all sound recorders.

Since with closer proximity the sound level is higher than with greater distance, this effect is again equalized by the sound transfer elements and, in connection with the transmission time elements the desired greater distance can be precisely simulated. The term transmission dimension includes amplification, attenuation and unaltered amplitude of the signal.

Further, the sound recorders can display directional characteristics and be aligned so that the axes of their main receiving directions are pointed to the respective reference position.

In this way, the feedback protection and isolation from ambient noise are again improved. The restricted sound recording angle of individual sound recorders does not have disadvantages, as more sound recorders are available, whose sound recording ranges overlap, and therefore give an even sound sensitivity within the recording range of the sound recording device.

The sound recorders are preferably designed directly as acoustic-electric transducers.

This embodiment is particularly mechanically-constructively simple to achieve. Furthermore electric signals can, without loss in quality, be easily processed, in particular filtered, delayed, amplified or attenuated.

Alternatively the sound recorders can be shown as input valves of acoustic signal transmitter, which are fed to one or several grouped acoustic-electric transducers.

This alternative offers the option of also achieving acoustic transmission times and attenuations, so that for equalization the downstream electronic switching can be simpler in design.

Furthermore an optical marking facility for the set-point of the sound source can be incorporated.

This measure makes it easier for the speaker to find his/her optimum speaking positions and to maintain them.

The optical marking facility is advantageously created by having at least two light sources, each which emits a characteristic light beam from the sound recorder device in the direction of the set-point of the sound source within the respective range for the most favorable sound recording.

With this measure, automatic deviations from the optimum speaking position are signaled to the speaker, so that he/she can correct his/her position at any time.

A further development sees the configuration of the sound recorders and/or their main receiving direction and/or the transmission times of the transmission time elements being adjusted to changes in the ideal position of the sound source, so that the reference position of the sound recording device can follow the desired position of the sound source.

This measure facilitates more freedom of movement for the speaker, without compromising feedback protection and isolation from ambient noise, and a lesser requirement to maintain a static, limited speaking position. Furthermore it can be adapted to speakers of different stature.

In so doing, the configuration of the sound recorders can be displaced and/or swiveled individually or grouped and a drive for displacing or swiveling them can be controlled either manually or by way of automatic position recognition of the sound source.

Further, the transmission times of the transmission time elements can be controlled either manually or by way of automatic position recognition of the sound source. The change in transmission times is also possible in combination with a change in the configuration of the sound recorders and/or their main receiving direction.

Suitable methods of position recognition can be based on the detection of thermal radiation from the face of the speaker, or radar, ultrasound or video picture processing.

According to a further development the activity and/or the position of the sound source can be determined by way of a correlator, which is fed signals from the sound recorders. Alternatively the position of the sound source can be calculated by measuring the time difference of the zero crossover of signals from the various sound recorders.

A correlator can determine the activity through the criteria of synchronous symmetrical or asymmetrical synchronously received signals at the sound recorders. This criteria indicates whether a sound source is at the reference position or in the vicinity of the reference position. The recognition of the activity can for example be used to connect through the sound recording device onto a public address system.

Furthermore the correlator can determine the position of the sound source by evaluating the phase displacements of the amplitude values received from the individual sound recorders, since these phase displacements are a measure of the distances of the sound source from the reference position.

In a preferred embodiment, the electric signals of the acoustic-electric transducers are, after digitalization, fed to a digital signal processor, which simulates the summation facility, transmission time elements, sound transfer elements and/or a correlator.

This facilitates very precise signal processing with high duplication accuracy. Special delay times can be achieved without losing quality, which can also be varied. Furthermore, transmission of several signal processing functions through the same signal processor are possible.

The sound recorders can also be designed as segments of a one-, two- or three-dimensional directionally deployed acoustic-electric transducer, whose surface is at least approximately, or in sections, of a circular or spherical element.

This embodiment depicts an alternative to the embodiment in which numerous individual acoustic-electric transducers are arranged directly next to one another on a circular or spherical element.

In the following, embodiment examples are explained with the assistance of diagrams.

The diagrams depict:

FIG. 1 A schematic representation of the sound recording device according to the invention with acoustic-electric transducers on a circular element.

Figure 2:
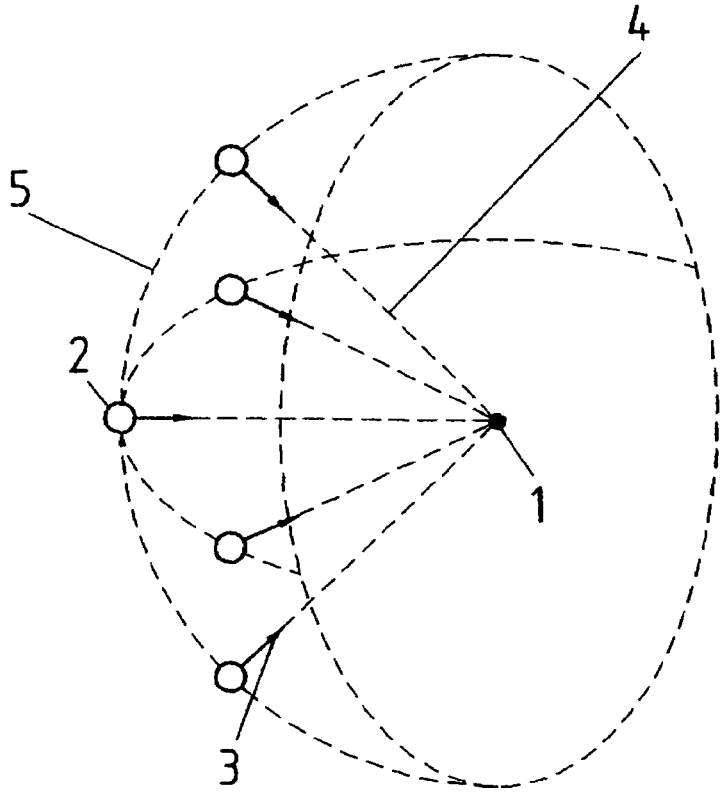

FIG. 2 A configuration of the acoustic-electric transducers on a spherical element.

Figure 3:
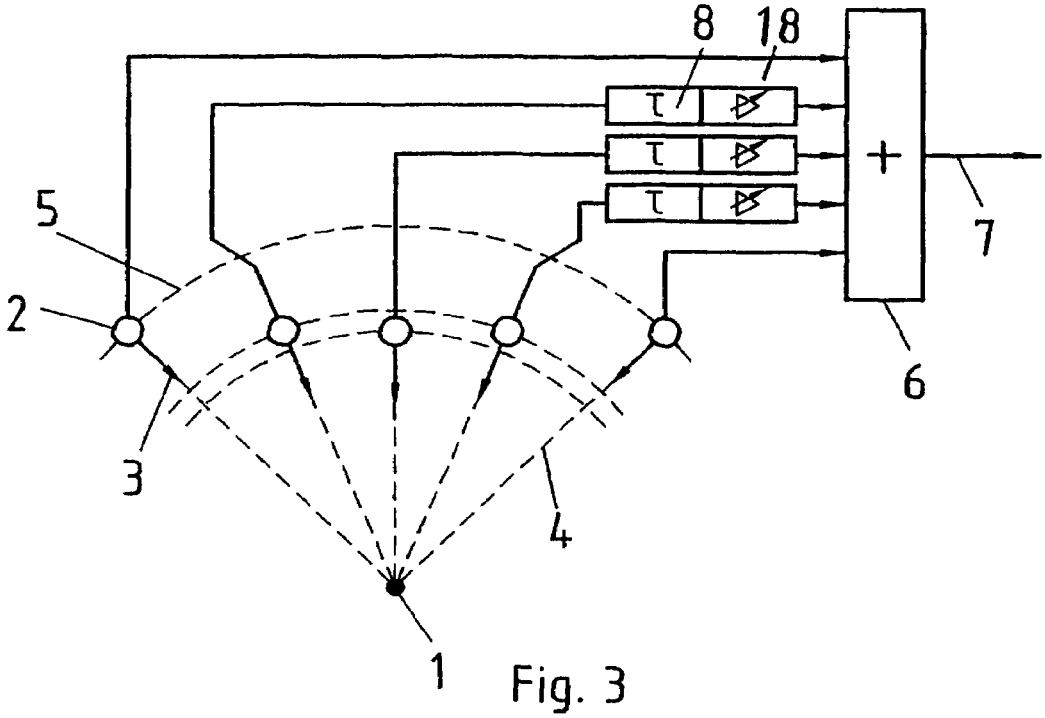

FIG. 3 A sound recording device with acoustic-electric transducers in a particular straight-line area.

Figure 4:
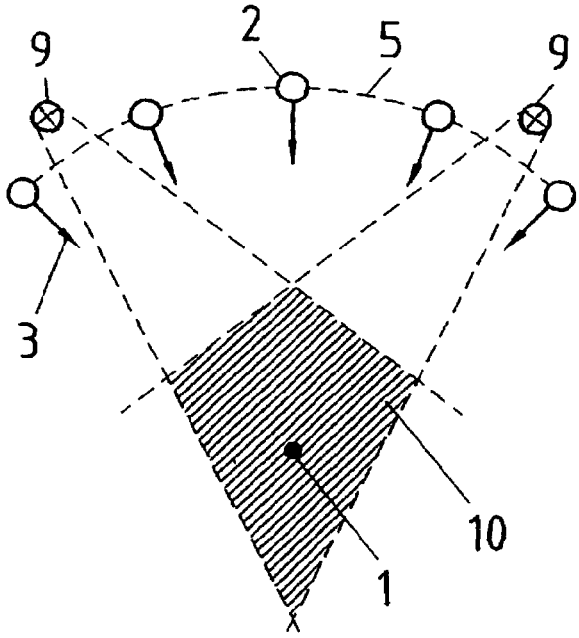

FIG. 4 An optical facility for marking the optimum speaking position

Figure 5:
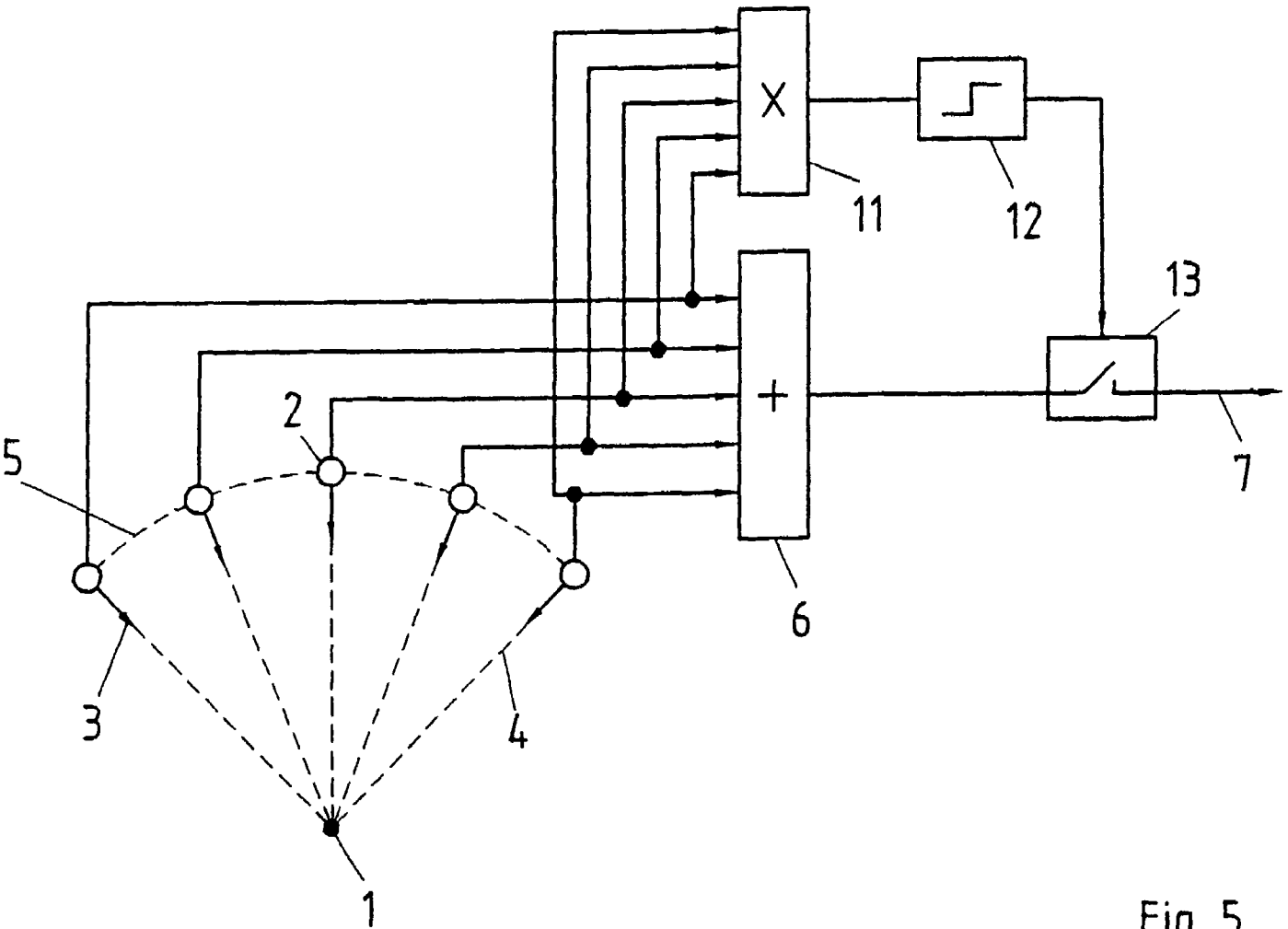

FIG. 5 A sound recording device with activity movement recognition.

Figure 6:
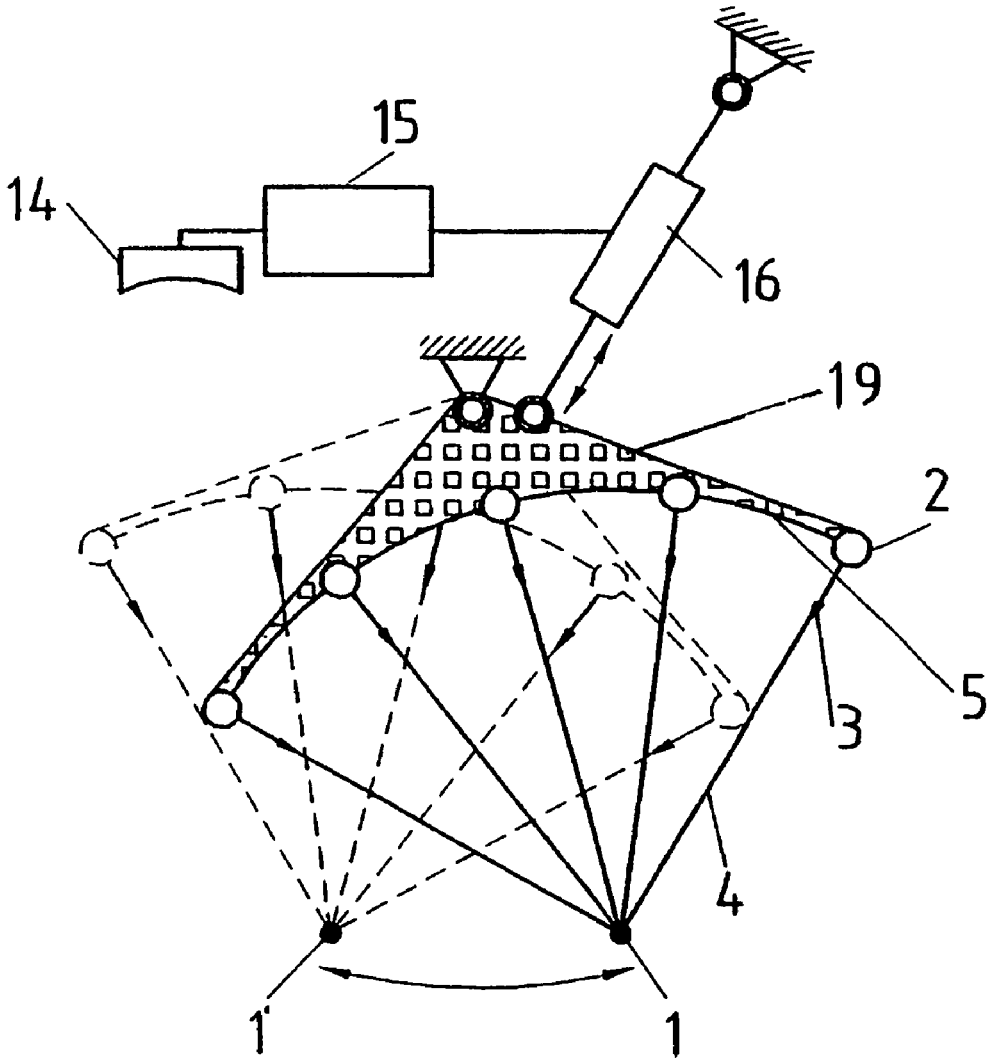

FIG. 6 A configuration for swiveling the sound recorders

Figure 7:
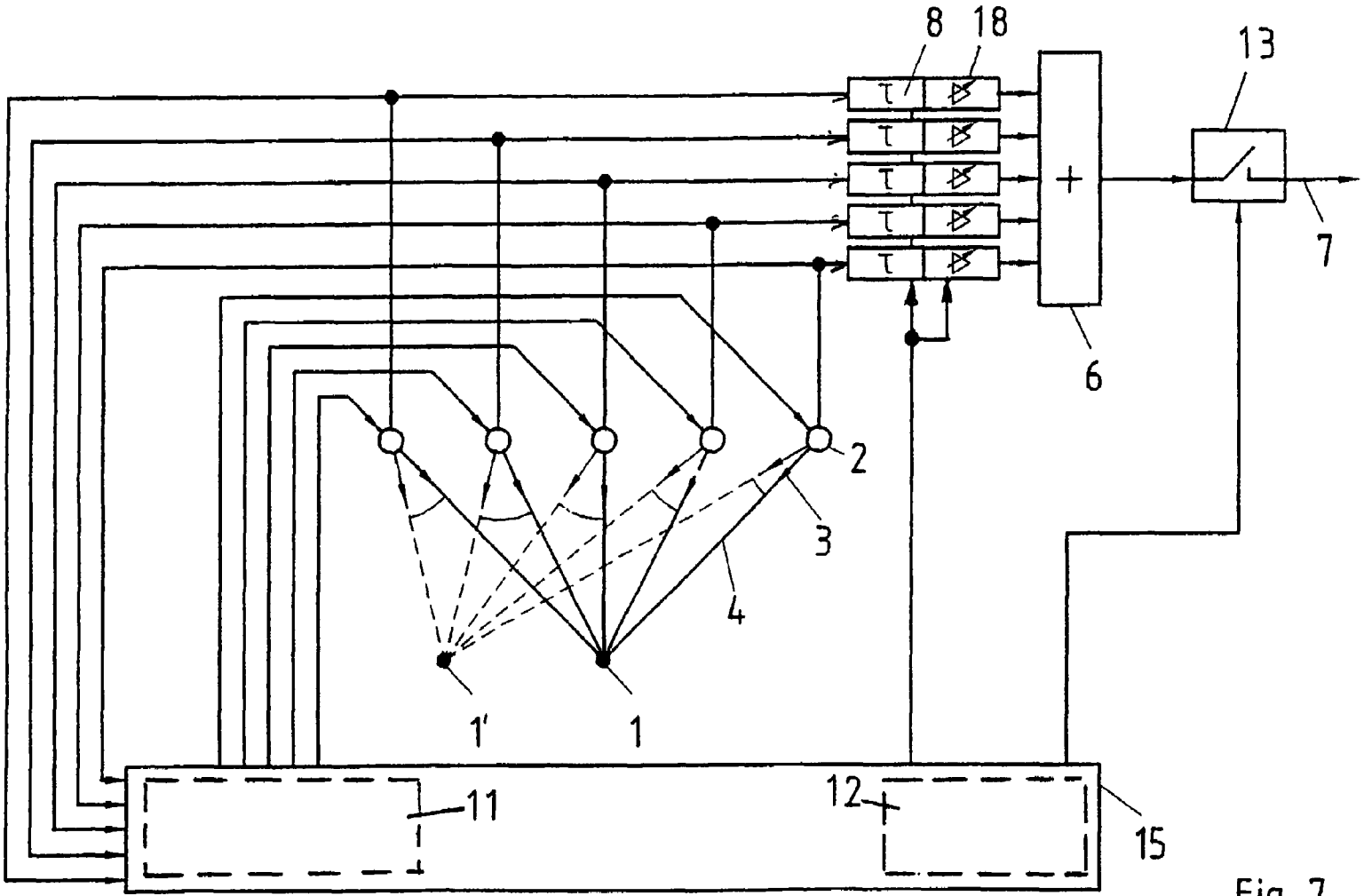

FIG. 7 A sound recording device with a facility for altering the main receiving direction.

Figure 8:
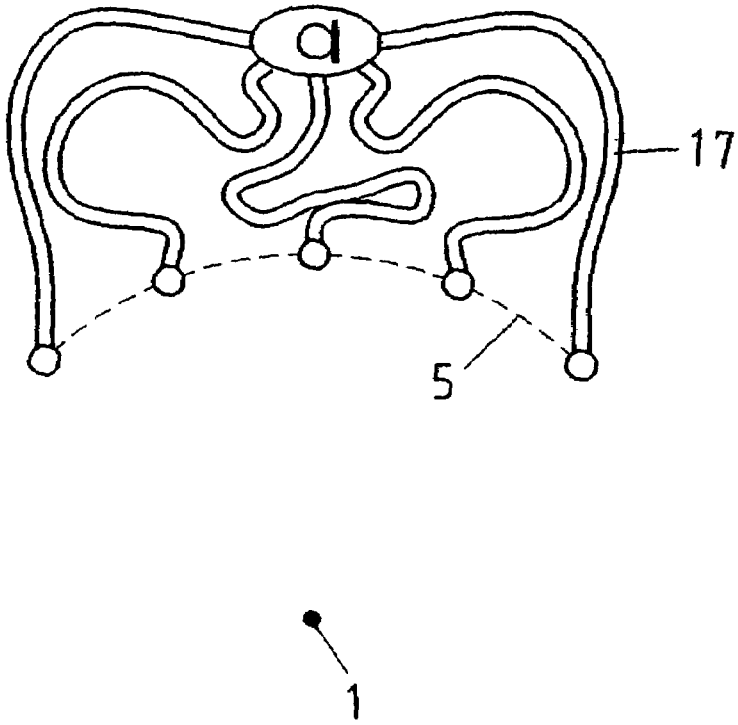

FIG. 8 A sound recording device with acoustic signal transmitters, and

FIG. 9*a*, 9*b* Representations of one- and multi-dimensional acoustic-electric transducers.

FIG. 1 shows a schematic representation of the sound recording device according to the invention with sound recorders 2 on a circular element 5. A reference position 1 corresponds to the ideal or desired position of a sound source. The sound recorders 2 are arranged so that directivity vectors 4 point in different directions between the reference position 1 and the sound recorders 2. The sound recorders 2, designed as direct acoustic-electric transducers, are in this case directional microphones, whose axes of their main receiving direction intersect at the reference position 1. The amplitudes of the output signals of the individual sound recorders 2 are summated in a downstream summation facility 6 and transmitted along a conducting signal path 7. Due to the identical distances of all the sound recorders 2 from the reference position 1, the output signals are essentially synchronous or similarly amplified. When the output signals configuration of the sound source is at, or in, the proximity of the reference position 1, the output signals are summated to the maximum possible output signal strength.

When the sound source deviates laterally from the reference position 1, the output signal strength decreases with increased proportionality. In contrast, the output signal strength remains, to a large degree, independent of the position of the sound source, when this is an area between the reference position 1 and the sound recorders 2. This is explained in that the sound source approximates the individual sound recorders 2, at or adjacent to their axes of the main receiving direction 3 and whose signal level increases thereupon, whilst the sound source simultaneously emits from the main receiving direction 3 of other sound recorders 2, and whose signal level thereupon decreases. Through the addition of all the output signals, both these effects can be compensated to a large degree.

Whilst in FIG. 1 the configuration of the sound recorders 2 is restricted to a circular element 5, FIG. 2 depicts an embodiment in which the configuration of the sound recorders 2 also extends into the third dimension. Here the sound recorders 2 are arranged on a spherical element 5. With this configuration an improved concentration of the reception at the reference position 1 is again achieved, as height deviations are also considered.

FIG. 3 shows sound recording device with sound recorders 2 in a straight line. Here, the sound recorders 2 are arranged at various distances from the reference position 1, namely the intersection of the main receiving direction 3 of the sound recorders 2. This configuration leads to a more compact configuration of the speaker podium. It is clear that the transmission time of the sound from the reference position 1 to the sound recorders 2 is different according to the various distances. The recording volume of the sound recorders 2 further away is likewise less. These differences are equalized here by transmission times elements 8 and sound transfer elements 18 switched downstream, which are assigned to the sound recorders 2 placed closer to the reference position 1. The transmission dimensions of the sound transfer elements 18 are comparable to an attenuation. By using the transmission time elements 8 and sound transfer elements 18 the middle four sound recorders 2 can be arranged virtually, as if they were the same distance from the reference position 1 as the outer sound recorders 2.

FIG. 4 shows an optical facility for marking the optimum speaking position. This device consists of two light sources 9, each of which emits light into a restricted predetermined zone. The predetermined zones are designed so the zones of the light distribution overlap and the reference position 1 lies in the center of these overlapping zones. Only in these intersecting zones 10 does the speaker see both light sources 9, which signals to him, that he is situated in an effective sound recording zone. If he sees only one light source 9, then he is outside of the effective sound recording zone and can thus correct his position.

FIG. 5 shows a sound recording device with activity recognition. In this case, the outputs of all sound recorders 2 are connected to a correlator 11. One output of the correlator 11 is connected via a threshold value detector 12 with a control input of a switch 13 at the switching output of the summation facility 6. The correlator 11 checks the output signals of the sound recorders 2 for coordination of their amplitudes and phases. Only if a sound source is placed at the reference position 1 do all amplitudes and phases correspond, which indicate a high correlation factor. With increased distance of the sound source from the reference position 1, the individual or multiple amplitude- and phase-values deviate more and more from the others, which minimizes the correlation factor.

The absolute value of the amplitude stays within wide parameters without any significant influence on the correlation factor established. In this way it can be automatically recognized as to whether a sound source is in the proximity of the reference position 1 or not. The correlation factor offers very reliable and fault-free criteria for the mobility of a sound source at or in the proximity of the reference position 1. The output signal of the correlator 11 can via the threshold value detector 12 and the control input of the switch 13, be used to automatically connect through microphone signals at conference centers.

FIG. 6 shows a configuration for swiveling the sound recorder 2. The sound recorder 2 is permanently affixed onto a mount 19, which can also be swiveled. A drive element 16 in the form of a pressure cylinder is coupled to the mount 19, so that the mount 19 can be swiveled. In order to adjust the sound recorders 2, control buttons can be used, which are attached to a control device 15. If at the same time an optical facility for marking the optimum speaker position is incorporated, then adjustment of the facility by the user is made considerably easier.

Instead of manual adjustment, the adjustment can also be performed automatically. In this case, the position of the face or body of the speaker is determined by a position recognition device 14, by means of a known method, such as automatic evaluation of thermal radiation from the face; evaluation of radar or ultrasound sensors; or evaluation of video pictures. With the help of this information controls the drive element 16 is controlled via the control device 15 in such a way that the altered reference position 1' comes as close as possible to the established position of the head.

FIG. 7 shows a sound recording device with a device for changing the main receiving direction 3. The sound recorders 2 are once again directional microphones. These have the special feature in that their main receiving direction 3 can be altered by electric control signals. For this, various solutions are known, for example by superimposing the signals of two sound recorders 2 installed close together.

The sound recorders 2 are affixed on a straight line. For the transmission times and amplitude equalization, corresponding transmission time elements 8, and sound transfer elements 18 are connected downstream of each sound recorder 2. The delay times of the transmission time elements 8 as well as the transmission dimensions of the sound transfer elements 18 are continuously adjustable via a control device 15. The output signals of the sound recorders 2 are fed to a correlator 11 which calculates the transmission delay variances of the sound with the sound recorders 2. The position of the sound source can be determined from these transmission time variances. Furthermore the control device 15 sends commands for adjusting the main receiving direction 3 for each of the sound recorders 2, without having to involve mechanical movements; also commands for adjusting the transmission time elements 8 and sound transfer elements 18, in order to correct the transmission delay variances and amplitude variances. In this case as well an altered reference position 1' arises. On account of the position information of the sound source at hand the control device 15 can additionally decide as to whether the sound source lies within the desired range, and can undertake to switch to the conducting signal path.

The depicted switching configuration can be altered in such a way, so that the correlator 11 can be connected behind the transmission time elements 8 and sound transfer elements 18. Further, it is possible to design the correlator 11, transmission time elements 8 and the sound transfer elements 18 as digital signal processors, i.e. all evaluations and adjustments are performed by software.

FIG. 8 shows a sound recording device with acoustic signal transmitters 17, which are fed to a single acoustic-electric transducer. In this way it is possible to reduce the number of acoustic-electric transducers, and likewise the costs thereof. In this, in places where previously acoustic-electric transducers were applied, acoustic signal transmitters 17 instead of the sound valves can be used. The sound valves can be attached in such a way, so that for the sound reception, a respective salient pole directivity is derived, which for example are known from directional tubes used as microphones, which work along the interference principle. The induction conductors 17, which are generally simple tubes, are all fed grouped to one single acoustic-electric transducer. The lengths of the acoustic signal transmitter 17 can be carefully selected so that the transmission time of the sound from the reference position 1 to the acoustic-electric transducer is the same as through all acoustic signal transmitters 17.

Figure 9:
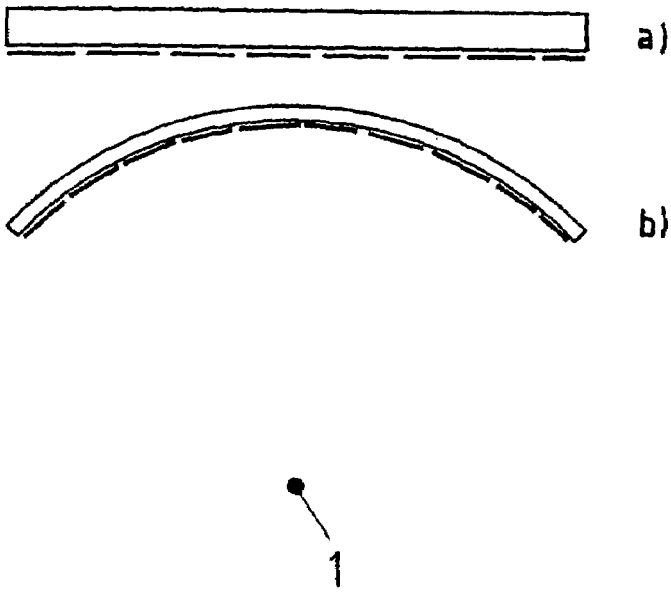

FIG. 9*a* shows the representation of a one-dimensional and in FIG. 9*b* a representation of a two or three dimensional elongated acoustic-electric transducer. According to FIG. 9 the surface is at least approximate, or in sections, of a circular or spherical element. This configuration is equal to a large number of acoustic-electric transducers, which are directly adjacent to one another. Even if the transducer is designed with a mechanically penetrating membrane, the individual elements work as a single acoustic-electric transducer whose signals here are integrally summated. Here also, directivity such as that with individual transducers is achieved.

The invention claimed is:

1. A sound pickup device for a public address system comprising:

at least two acoustic sensors for simultaneously picking up sound emitted from a sound source and converting into electric signals, said acoustic sensors being spaced from a useful zone from which useful signals emanate, said acoustic sensors having directional characteristics and being oriented so that the axes of their main reception directions are directed towards a reference position within the useful zone, said acoustic sensors being arranged with differing spacing to the reference position, the reference position corresponding to an ideal set position of the sound source, and directional vectors between said reference position and the acoustic sensors point in different directions;

a common signal amplitude add device electrically or acoustically connected to said acoustic sensors, said add device combining the electrical signals received from all the acoustic sensors; and delay elements associated with individual ones or all of said acoustic sensors, said delay elements equalizing acoustic transmission times from the sound source to the acoustic sensors;

wherein said delay elements have a delay time controlled by automatic position detection of the sound source and only the delay time of the delay elements is automatically adjusted individually with respect to each acoustic sensor to a modification of the actual position of the sound source without adjusting the arrangement of the acoustic sensors or their main reception directions.

2. The sound pickup device according to claim 1, wherein the acoustic sensors are arranged in a straight line.

3. The sound pickup device according to claim 1, wherein the activity and/or the position of the sound source is determined by a correlator, to which are supplied the signals of the acoustic sensors or the position of the sound source is determined by measuring the time difference of zero crossings of the signals of different acoustic sensors.

4. The sound pickup device according to claim 3, wherein the electric signals of the acoustic-electric transducers, following digitization, are supplied to a digital signal processor, which executes the functions of an adder, and/or one or more delay elements, and/or the correlator.

5. The sound pickup device according to claim 3 further comprising a threshold value detector connected to the correlator, and a switch having a switch control input at a switching output of the threshold value detector, said correlator having an output connected via the threshold value detector with the switch control input to automatically connect the output of the common signal amplitude add device to a public address system when a correlation factor indicates acoustic activity within the useful zone.

6. The sound pickup device according to claim 1 further comprising additional transmission elements whose transmission coefficients are adjustable to a consistent signal level of all acoustic sensors.

7. The sound pickup device according to claim 1, further comprising a control device, said control device sending commands for individually adjusting the axes of the main reception directions of the acoustic sensors in response to automatic position detection of the sound source without mechanical displacement or pivoting of the acoustic sensors.

8. The sound pickup device according to claim 1 further comprising an optical marking for indicating the ideal set position of the sound source.

9. The sound pickup device according to claim 8, wherein the optical marking system is created by at least two light sources, which in each case emits a characteristic light beam from the sound pickup device in the direction of the set position of the sound source within a respective predetermined zone for the most favorable sound pickup.

10. A sound pickup device for a public address system comprising:

at least two acoustic sensors for simultaneously picking up sound emitted from a sound source and converting into electric signals, said acoustic sensors being spaced from a useful zone from which useful signals emanate, said acoustic sensors having directional characteristics and being oriented so that the axes of their main reception directions are directed towards a reference position within the useful zone, said acoustic sensors being arranged with differing spacing to the reference position, the reference position corresponding to an ideal set position of the sound source, and directional vectors between said reference position and the acoustic sensors point in different directions;

a common signal amplitude add device electrically or acoustically connected to said acoustic sensors, said add device combining the electrical signals received from all the acoustic sensors; and delay elements associated with individual ones or all of said acoustic sensors, said delay elements equalizing acoustic transmission times from the sound source to the acoustic sensors wherein the activity and/or the position of the sound source is determined by a correlator, to which are supplied the signals of the acoustic sensors or the position of the sound source is determined by measuring the time difference of zero crossings of the signals of different acoustic sensors.

11. The sound pickup device according to claim 10, wherein the electric signals of the acoustic-electric transducers, following digitization, are supplied to a digital signal processor, which executes the functions of an adder, and/or one or more delay elements, and/or the correlator.

12. The sound pickup device according to claim 10 further comprising an optical marking for indicating the ideal set position of the sound source.

13. The sound pickup device according to claim 12, wherein the optical marking system is created by at least two light sources, which in each case emits a characteristic light beam from the sound pickup device in the direction of the set position of the sound source within a respective predetermined zone for the most favorable sound pickup.

14. The sound pickup device according to claim 10, wherein the arrangement of the acoustic sensors and/or their main receiving directions and/or the delay time of the delay elements is automatically adjusted to a modification of the actual position of the sound source so that the reference position of the sound recording device follows the actual position of the sound source.

15. The sound pickup device according to claim 14, further comprising a control device, said control device sending commands for individually adjusting the axes of the main reception directions of the acoustic sensors in response to automatic position detection of the sound source without mechanical displacement or pivoting of the acoustic sensors.

16. The sound pickup device according to claim 10, wherein the acoustic sensors are designed as segments of a one-, two-, or three dimensional directional elongated acoustic-electric transducer, whose surface at least approximately, or in a section, corresponds to a circular or spherical element.

17. The sound pickup device according to claim 10 further comprising additional transmission elements whose transmission coefficients are adjustable to a consistent signal level of all acoustic sensors.

18. The sound pickup device according to claim 10 further comprising a threshold value detector connected to the correlator, and a switch having a switch control input at a switching output of the threshold value detector, said correlator having an output connected via the threshold value detector with the switch control input to automatically connect the output of the common signal amplitude add device to a public address system when a correlation factor indicates acoustic activity within the useful zone.

19. The sound pickup device according to claim 10, wherein the acoustic sensors are arranged in a straight line.

20. The sound pickup device according to claim 10 wherein the acoustic sensors are constructed as inlets of acoustic waveguides which lead to one or more common acoustic-electric transducers.

21. The sound pickup device according to claim 10 wherein said delay elements have a delay time controlled by automatic position detection of the sound source and only the delay time of the delay elements is automatically adjusted individually with respect to each acoustic sensor to a modification of the actual position of the sound source without adjusting the arrangement of the acoustic sensors or their main reception directions.

22. A sound pickup device for a public address system comprising:

at least two acoustic sensors for simultaneously picking up sound emitted from a sound source and converting into electric signals, said acoustic sensors being spaced from a useful zone from which useful signals emanate, said acoustic sensors having directional characteristics and being oriented so that the axes of their main reception directions are directed towards a reference position within the useful zone, said acoustic sensors being arranged with the same spacing from the reference position, the reference position corresponding to an ideal set position of the sound source, and directional vectors between said reference position and the acoustic sensors point in different directions; and a common signal amplitude add device electrically or acoustically connected to said acoustic sensors, said add device combining the electrical signals received from all the acoustic sensors;

wherein the activity and/or the position of the sound source is determined by a correlator, to which are supplied the signals of the acoustic sensors or the position of the sound source is determined by measuring the time difference of zero crossings of the signals of different acoustic sensors.

23. The sound pickup device according to claim 22, further comprising delay elements associated with individual ones or all of said acoustic sensors, said delay elements equalizing acoustic transmission times from the sound source to the acoustic sensors.

24. The sound pickup device according to claim 23 further comprising additional transmission elements whose transmission coefficients are adjustable to a consistent signal level of all acoustic sensors.

25. The sound pickup device according to claim 23, further comprising a control device, said control device sending commands for individually adjusting the axes of the main reception directions of the acoustic sensors in response to automatic position detection of the sound source without mechanical displacement or pivoting of the acoustic sensors.

26. The sound pickup device according to claim 23 wherein said delay elements have a delay time controlled by automatic position detection of the sound source and only the delay time of the delay elements is automatically adjusted individually with respect to each acoustic sensor to a modification of the actual position of the sound source without adjusting the arrangement of the acoustic sensors or their main reception directions.

27. The sound pickup device according to claim 22, wherein the electric signals of the acoustic-electric transducers, following digitization, are supplied to a digital signal processor, which executes the functions of an adder, and/or one or more delay elements, and/or the correlator.

28. The sound pickup device according to claim 22, wherein the acoustic sensors are designed as segments of a one-, two-, or three dimensional directional elongated acoustic-electric transducer, whose surface at least approximately, or in a section, corresponds to a circular or spherical element.

29. The sound pickup device according to claim 22 further comprising an optical marking for indicating the ideal set position of the sound source.

30. The sound pickup device according to claim 29, wherein the optical marking system is created by at least two light sources, which in each case emits a characteristic light beam from the sound pickup device in the direction of the set position of the sound source within a respective predetermined zone for the most favorable sound pickup.

31. The sound pickup device according to claim 22 further comprising a threshold value detector connected to the correlator, and a switch having a switch control input at a switching output of the threshold value detector, said correlator having an output connected via the threshold value detector with the switch control input to automatically connect the output of the common signal amplitude add device to a public address system when a correlation factor indicates acoustic activity within the useful zone.

32. The sound pickup device according to claim 22, further comprising delay elements associated with individual ones or all of said acoustic sensors, wherein the arrangement of the acoustic sensors and/or their main receiving directions and/or the delay time of the delay elements is automatically adjusted to a modification of the actual position of the sound source so that the reference position of the sound recording device follows the actual position of the sound source.

33. The sound pickup device according to claim 32, wherein the acoustic sensors are displaced and/or pivoted individually and a displacement and/or pivoting drive is controlled by automatic position detection of the sound source.

34. The sound pickup device according to claim 22, wherein the acoustic sensors are arranged in a straight line.

35. The sound pickup device according to claim 22 wherein the acoustic sensors are constructed as inlets of acoustic waveguides which lead to one or more common acoustic-electric transducers.

* * * * *